US012728501B2

(12) United States Patent
Liu et al.

(10) Patent No.: US 12,728,501 B2
(45) Date of Patent: Sep. 8, 2026

(54) BLOCK-TYPE STRUCTURED DIAMOND GRINDING WHEEL WITH ADAPTIVE SUPPLY OF INSTANTANEOUS COOLING

(71) Applicant: HUNAN INSTITUTE OF SCIENCE AND TECHNOLOGY, Yueyang (CN)

(72) Inventors: Jiaming Liu, Yueyang (CN); Xlaohong Zhang, Yueyang (CN); Liwei Ning, Yueyang (CN); Jia Duan, Yueyang (CN); Xiong Tang, Yueyang (CN); Wei Li, Yueyang (CN); Zhiyuan Yang, Yueyang (CN); Wanyi Tian, Yueyang (CN); Shiguo Teng, Yueyang (CN)

(73) Assignee: HUNAN INSTITUTE OF SCIENCE AND TECHNOLOGY, Yueyang (CN)

( * ) Notice: Subject to any disclaimer, the term of this patent is extended or adjusted under 35 U.S.C. 154(b) by 559 days.

(21) Appl. No.: 18/212,201

(22) Filed: Jun. 21, 2023

(65) Prior Publication Data

US 2023/0330815 A1 Oct. 19, 2023

Related U.S. Application Data

(63) Continuation of application No. PCT/CN2021/127827, filed on Oct. 20, 2021.

(30) Foreign Application Priority Data

Dec. 28, 2020 (CN) ..... 202011579041.2

(51) Int. Cl.
*B24D 5/10* (2006.01)
*B24D 5/06* (2006.01)

(52) U.S. Cl.
CPC ..... *B24D 5/10* (2013.01); *B24D 5/06* (2013.01)

(58) Field of Classification Search
CPC ..... B23D 59/02; B23D 59/025; B24B 55/02; B24D 5/10; B24D 5/06; B24D 5/123
(Continued)

(56) References Cited

U.S. PATENT DOCUMENTS 2,767,523 A * 10/1956 Vasbinder ..... B24B 33/08 451/464
3,795,078 A * 3/1974 Coes, Jr. ..... B23D 61/06 451/543

(Continued)

FOREIGN PATENT DOCUMENTS

CN 105773324 A 7/2016
CN 109848875 A 6/2019

(Continued)

OTHER PUBLICATIONS

Dietrich, EP-0163843-A2 machine translation, Dec. 11, 1985 (Year: 1985).*

*Primary Examiner* — Brian D Keller
*Assistant Examiner* — Marcel T Dion

(57) ABSTRACT

A Block-Type structured diamond grinding wheel with adaptive supply of instantaneous Cooling, includes a grinding wheel substrate and several grinding wheel units, each including an execution mechanism, a push mechanism, and an instantaneous Cooling mechanism. Various structured patterns are provided on an upper surface of the grinding unit in the execution mechanism, and a heat sink is disposed at a lower surface. During operation, a tangential grinding force generated by the grinding unit and a workpiece presses a sprayer to spray nano fluid into an operating region, to implement instantaneous Cooling of grinding wheel. When wear occurs in a grinding unit of a grinding wheel, a corresponding grinding unit may be replaced to extend the service life of the grinding wheel, and production costs are reduced. A special surface structure of the grinding unit (Continued)

further enhances a cooling effect, thereby improving a surface quality of a workpiece.

5 Claims, 6 Drawing Sheets

(58) Field of Classification Search
USPC ..... 451/542, 543
See application file for complete search history.

(56) References Cited

U.S. PATENT DOCUMENTS 4,010,583 A * 3/1977 Highberg ..... B24B 13/01 228/173.6
7,703,359 B2 * 4/2010 Englund ..... B23B 29/242 407/101
11,426,810 B2 * 8/2022 Willer ..... B28D 1/121
2007/0056574 A1 * 3/2007 Kim ..... B24D 99/005 125/13.01
2010/0011923 A1 * 1/2010 Suda ..... C10M 169/04 451/7
2014/0187130 A1 * 7/2014 Gosamo ..... B24D 18/0009 451/542
2017/0106489 A1 * 4/2017 Haas ..... B24B 55/02
2018/0178348 A1 * 6/2018 Xiao ..... B24D 7/06
2020/0282411 A1 * 9/2020 Li ..... B05B 5/043

FOREIGN PATENT DOCUMENTS

CN 111958057 A 11/2020
CN 112706084 A 4/2021
EP 0163843 A2 * 12/1985 ..... B28D 1/121
GB 820308 A * 9/1959 ..... B23Q 11/103
JP 10180637 A 7/1998
KR 20170040811 A 4/2017

* cited by examiner

BLOCK-TYPE STRUCTURED DIAMOND GRINDING WHEEL WITH ADAPTIVE SUPPLY OF INSTANTANEOUS COOLING

RELATED APPLICATION

The present application claims the priority of China Invention Patent application No. 202011579041.2, titled "Block Type Structured Diamond Grinding Wheel with Adaptive Supply of Instantaneous Cooling" filed on Dec. 28, 2020.

FIELD OF THE INVENTION

The present invention relates to the field of grinding wheel grinding, and specifically to a Block-Type structured diamond grinding wheel with adaptive supply of Instantaneous Cooling.

BACKGROUND

As the most important part of grinding processing, a grinding wheel plays a central role in the grinding processing and generally includes an abrasive, a bonding agent, and a bore. A Block-Type grinding wheel uses a removable and replaceable grinding unit to process a workpiece. When severely worn, the grinding unit may be replaced or repaired to restore the grinding performance of the grinding wheel. The Block-Type grinding wheel has advantages such as simple and convenient to assemble and disassemble, long service life, and low production costs. At present, only a single cooling method with an external coolant feed is used for a Block-Type grinding wheel, which has low cooling efficiency and cannot respond to complex working conditions in a timely manner during grinding processing. Moreover, due to the closed nature of an air barrier and a grinding region, an effective amount of grinding fluid that can effectively enter the grinding region is extremely limited. This also directly leads to a large accumulation of heat in the grinding region and even thermal damage, which affects the performance and processing effect of the grinding wheel.

For a Block-Type grinding wheel, a patent titled "Coated Abrasive Grain Insert-type Brazed Grinding Wheel" (Publication Number: CN105643483B) has been published, the principle of which is to arrange a plurality of heat sink grooves evenly in side walls of a base and a cover of a grinding wheel to promote the circulation of grinding fluid and enhance heat exchange in a grinding region. In addition, production costs are reduced by coating a surface of an ordinary abrasive with a diamond film. The grinding wheel has solved the problems of heat dissipation and wear of the grinding wheel to a certain extent. However, this technical solution still has the following problems: A cooling mode of the grinding wheel is not fundamentally changed. With only an external grinding fluid feed, there is still a large amount of heat accumulation or even thermal damage. The solution does not respond to complex working conditions in a timely manner during grinding of the grinding wheel, and cannot effectively reduce wear in a surface of the grinding wheel.

In summary, how to implement "effective", "instant", and "adaptive" supply of grinding fluid during grinding of a diamond grinding wheel and a "flexible" grinding wheel structure has become an urgent problem to be solved.

SUMMARY

In order to solve technical problems such as a single cooling method, heat accumulation, and inability to respond to complex working conditions during processing of a grinding wheel, an objective of the present invention is to provide a Block-Type structured diamond grinding wheel with adaptive supply of instantaneous Cooling.

To achieve the foregoing objective, the present invention provides a Block-Type structured diamond grinding wheel with adaptive supply of instantaneous Cooling, wherein the grinding wheel is formed by a grinding wheel substrate and several grinding wheel units, each grinding wheel unit includes an execution mechanism, a push mechanism, and an instantaneous Cooling mechanism, the grinding wheel is arranged to rotate clockwise to process a workpiece by using the execution mechanism;

a plurality of grooves are opened in outer circumferential surface of the grinding wheel substrate, and an assembly hole is opened at center of the grinding wheel substrate;

the grooves form an annular array structure on surface of the grinding wheel substrate; each execution mechanism includes a grinding unit, a hinge, a push rod and a heat sink, wherein the grinding unit has an umbrella-shaped structure, an "umbrella top" of the grinding unit is arc-shaped, and a width of the grinding unit is consistent with a width of the grinding wheel;

an upper surface of each grinding unit is coated with a layer of a diamond abrasive, and the diamond abrasive is ablated by using a laser process technique to form a structured pattern, a small hole is opened in a lower surface of the grinding unit, through which the grinding unit is amounted to the heat sink;

a bottom of the grinding unit is hinged to the push rod by a hinge, so as to drive the push mechanism to press the instantaneous Cooling mechanism to spray nano fluid to implement instantaneous Cooling of the grinding region, when a tangential grinding force imposed on the grinding unit increases and exceeds a set threshold.

When workpiece is processed by using the execution mechanism, external coolant is conveyed to a grinding region. When a tangential grinding force increases and exceeds a set threshold, the execution mechanism drives the push mechanism to press the instantaneous Cooling mechanism to spray nano fluid to implement instantaneous Cooling of the grinding region. A plurality of grooves are opened in an outer circumferential surface of the grinding wheel substrate. An assembly hole is opened at a center. The grooves form an annular array structure in the grinding wheel substrate. A grinding unit in the execution mechanism has an umbrella-shaped structure. An "umbrella top" of the grinding unit is arc-shaped. A width of the grinding unit is consistent with a width of the grinding wheel. An upper surface of the grinding unit is coated with a layer of a diamond abrasive. Then the diamond abrasive is ablated by using a laser process technique to form a structured pattern. A small hole is opened in a lower surface of the grinding unit. The grinding unit is connected to a heat sink by a bolt. A bottom of the grinding unit is hinged to a push rod by a hinge.

Further, the grinding unit in the execution mechanism is made of aluminum alloy; and the heat sink is made of copper, and the heat sink has a sheet structure.

Further, the grinding units with different structured patterns are separately chosen according to different processing conditions and processing requirements and are flexibly arranged on the grinding wheel, and after a grinding process ends, the grinding unitsare detached and are kept for reassembly into the grinding wheel for another time of use in a next grinding process.

Further, the push mechanism comprises an outer frame body, a main shaft, a spring, a piston, and a nut, a left end of the main shaft passes through the outer frame body, a plurality of springs are disposed between the main shaft and the outer frame body, and the piston is fastened to the main shaft by the nut; and during operation, the piston compresses the springs to drive the main shaft to press a sprayer.

Further, a quantity of springs in the push mechanism is selected according to a different material of the workpiece to be processed, to change the set threshold of tangential force; when the material of the workpiece is difficult to process, the quantity of the springs is increased; and when the material of the workpiece is easy to process, the quantity of the springs is reduced.

Further, the instantaneous Cooling mechanism comprises a sprayer and an annular fastener, the sprayer is made of a silicone material, has soft texture, and is smooth to press; a small conical hole is opened at a top of the sprayer to control amount of discharge; and the instantaneous Cooling mechanism contains nano fluid therein.

Further, nanoparticles contained in the nano fluid in the instantaneous Cooling mechanism are molybdenum disulfide.

The beneficial effects of the present invention are as follows:

1. "Effective" supply of grinding fluid: An adaptive sprayer is embedded in the grinding wheel. Instantaneous Cooling function of a grinding region of a grinding wheel is added in addition to external conveyance and cooling. Double cooling supply greatly improves cooling efficiency, and reduces a waste of grinding fluid and wear of the grinding wheel. A surface of a grinding unit is ablated by using a laser process technique to form a structured pattern thereon. A distribution state of the grinding fluid on a surface of the grinding wheel becomes more uniform by means of gaps between grinding units and a structured feature, and a maximum effective flow is obtained. A debris accommodating space in the surface of the grinding wheel is increased. Cooling and lubricating conditions are improved. Grinding temperature and grinding subsurface damage are reduced.
2. "Instantaneous" supply of grinding fluid: When a tangential grinding force exceeds a set threshold, an instantaneous Cooling mechanism embedded inside the grinding wheel sprays nano fluid inside the grinding region, to implement "instant" supply of grinding fluid, thereby fundamentally changing a brittle-ductile zone of a material and eliminating a transition critical condition.
3. "Adaptive" supply of grinding fluid: A quantity of springs in a push mechanism determines a tangential grinding force threshold. When a tangential grinding force exceeds the set threshold, the sprayer in the instantaneous Cooling mechanism sprays the nano fluid. When the lubricating condition in the grinding region is improved and the tangential grinding force is less than the set threshold, the sprayer stops spraying. "Adaptive" supply of grinding fluid according to an actual grinding condition is implemented, thereby ensuring controlled and efficient supply of the nano fluid.
4. "Flexible" grinding wheel structure: Grinding units with different structured patterns are separately chosen, and are flexibly arranged on a main block of the grinding wheel, to satisfy different processing conditions and processing requirements. Grinding units with different widths are replaced, so that a grinding width of the grinding wheel can be changed, to flexibly adapt to processing of workpieces with different widths. A "flexible" grinding wheel structure is implemented.

Figure 1:
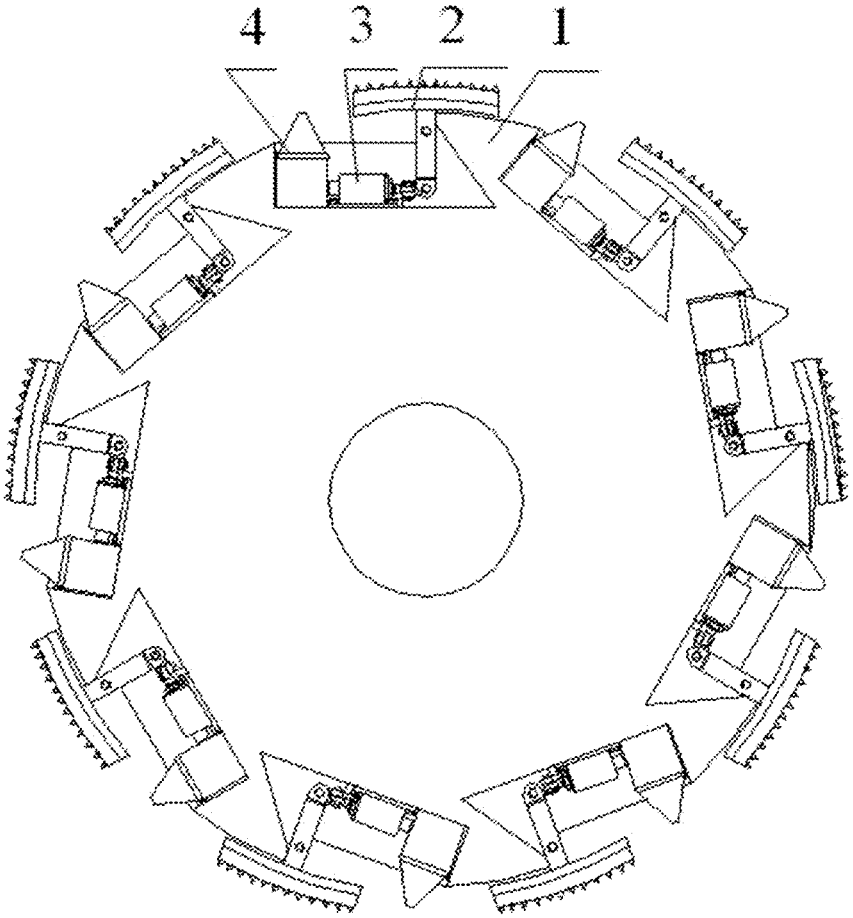
FIG. 1 is a front view of a Block-Type structured diamond grinding wheel with adaptive supply of instantaneous Cooling according to a specific implementation of the present invention.
Figure 2:
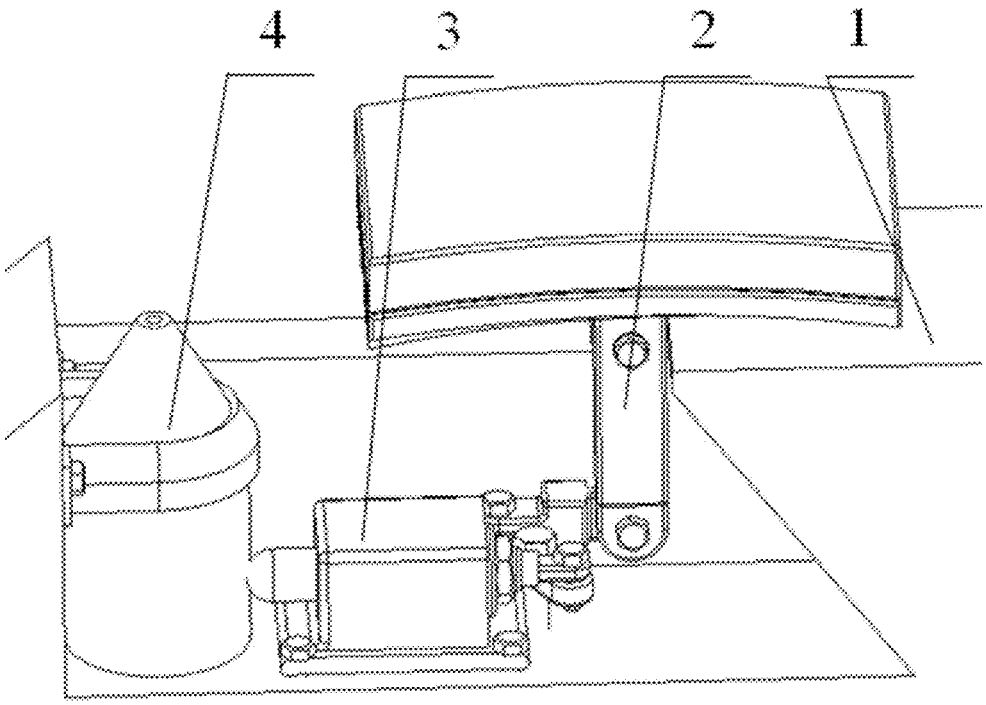
FIG. 2 is a three-dimensional partial enlarged view of a grinding wheel according to a specific implementation of the present invention.

Reference numerals in FIG. 1 to FIG. 6: 1—grinding wheel substrate, 1.1—groove, 2—execution mechanism, 2.1—grinding unit, 2.2—hinge, 2.3—push rod, 2.4—heat sink, 2.5—hinge bolt, 2.6—connecting rod, 2.7—bolt, 3—push mechanism, 3.1—bolt, 3.2—nut, 3.3—piston, 3.4—outer frame body, 3.5—main shaft, 3.6—spring, 4—instantaneous Cooling mechanism, 4.1—sprayer, and 4.2—annular fastener.

DETAILED DESCRIPTION OF EMBODIMENTS

To enable a person skilled in the art to better understand the technical solutions of the present invention, the present invention is further described below in detail with reference to the accompanying drawings and specific embodiments.

FIG. 1 is a front view of a Block-Type structured diamond grinding wheel with adaptive supply of instantaneous Cooling according to the present invention, mainly including a grinding wheel substrate 1, an execution mechanism 2, a push mechanism 3, and an instantaneous Cooling mechanism 4.

Figure 3:
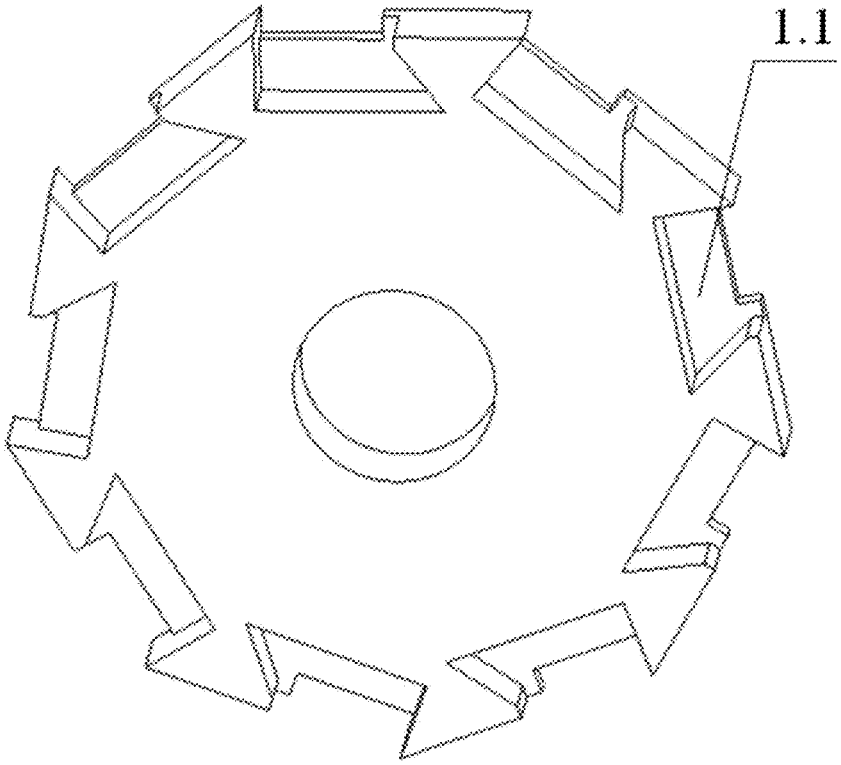
FIG. 3 is a three-dimensional schematic structural diagram of a grinding wheel substrate according to a specific implementation of the present invention.

Referring to FIG. 3, a plurality of grooves 1.1 are arranged outer circumferential surface of the grinding wheel substrate 1. The grooves 1.1 form an annular array structure with the middle/center of the grinding wheel substrate 1 as a center. An assembly hole is opened at the center of the grinding wheel substrate 1.

Figure 4:
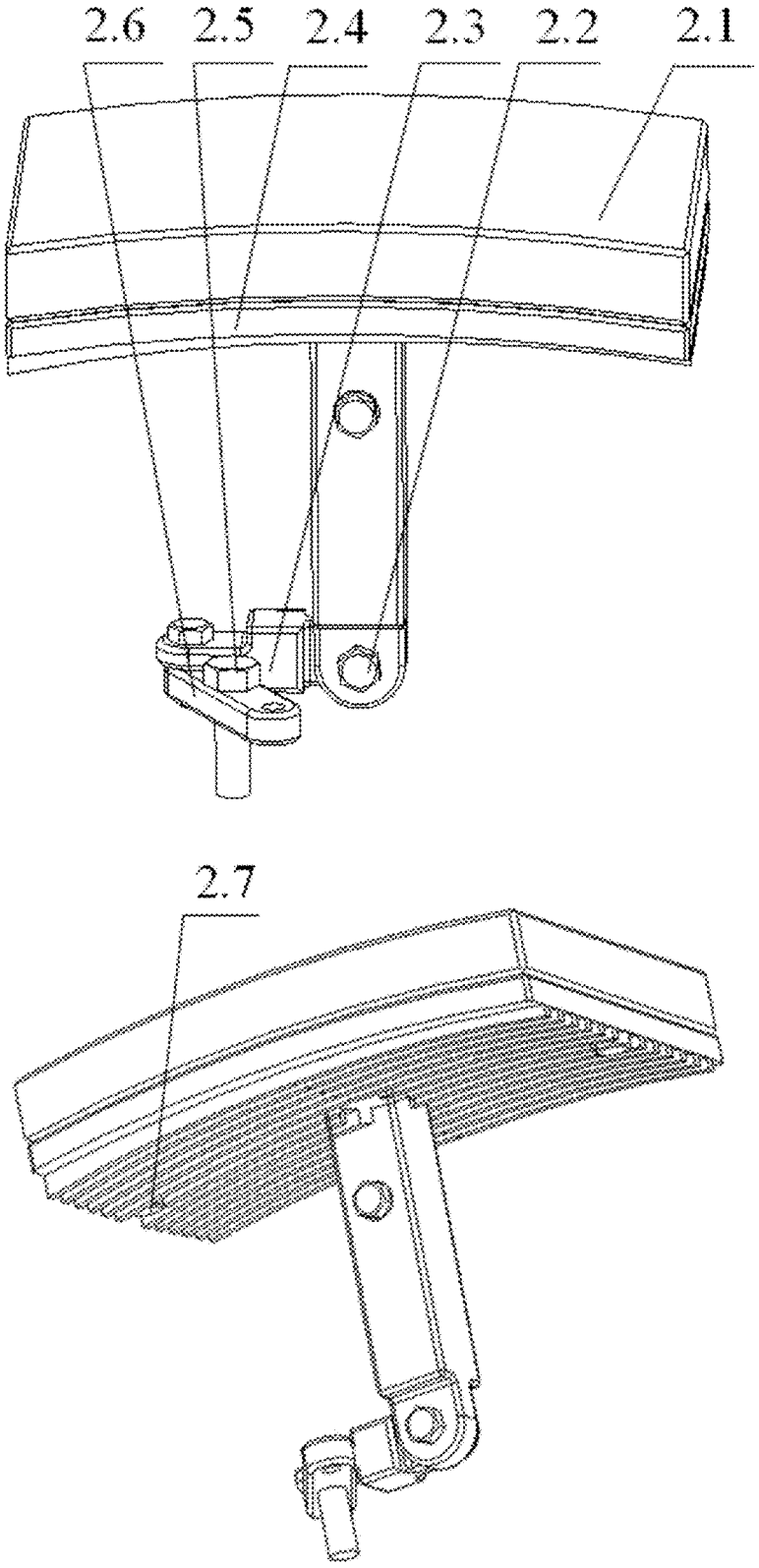
FIG. 4 is a three-dimensional schematic structural diagram of an execution mechanism according to a specific implementation of the present invention.

Referring to FIG. 4, the execution mechanism 2 includes a grinding unit 2.1, a heat sink 2.4, a push rod 2.3, and a connecting rod 2.6. The grinding unit 2.1 has an umbrella-shaped structure. A width of the grinding unit 2.1 is consistent with the width of the grinding wheel. An upper surface of the grinding unit is coated with a layer of a diamond abrasive, and is ablated by using a laser process technique to form various structured patterns. A lower surface of the grinding unit is connected to the heat sink 2.4 by a bolt 2.7.

A connecting hole is opened in an upper portion of a "handle" structure of the grinding unit 2.1, and is connected to the grinding wheel substrate 1 by a hinge bolt 2.5. A material of the heat sink 2.4 is aluminum alloy, and the heat sink adopts a sheet structure, which can accelerate heat dissipation during the operation of the grinding wheel. A first end of the push rod 2.3 is hinged to a bottom of the grinding unit 2.1, and a second end of the push rod 2.3 is hinged to a first end of the connecting rod 2.6 by a hinge 2.2. A second end of the connecting rod 2.6 is hinged to a main shaft 3.5 of the push mechanism 3 by another hinge 2.2. A connecting hole is arranged in middle portion of the connecting rod 2.6, and a hinge bolt 2.5 passes through the connecting hole and connects the connecting rod to the grinding wheel substrate 1.

Figure 5:
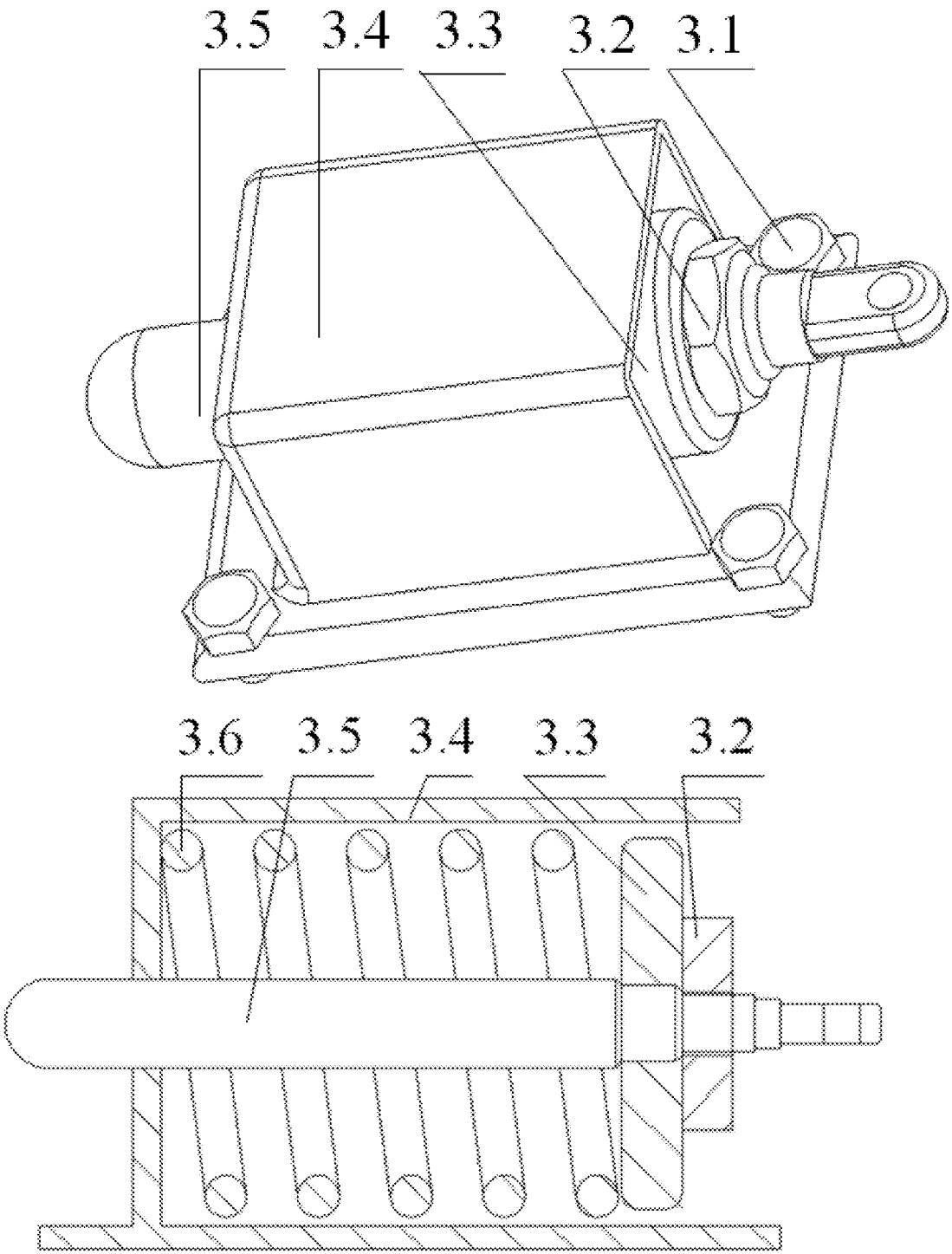
FIG. 5 is a three-dimensional schematic structural diagram and a cross-sectional view of a push mechanism according to a specific implementation of the present invention.

Referring to FIG. 5, the push mechanism 3 includes an outer frame body 3.4, the main shaft 3.5, a spring 3.6, a piston 3.3, and a nut 3.2. The outer frame body 3.4 is securely connected to the grinding wheel substrate 1 by bolts 3.1. A hole is opened at an end of the outer frame body. A left end of the main shaft 3.5 passes through the outer frame body 3.4, and a plurality of springs 3.6 are disposed between the left end and the outer frame body 3.4. The piston 3.3 is fastened on the main shaft 3.5 by the nut 3.2. The spring 3.6 is placed between the outer frame body 3.4 and the piston 3.3. A quantity of the springs 3.6 can be increased or reduced according to a different material of a workpiece to be processed, to set different tangential grinding force thresholds. When the material of the workpiece is difficult to process, the quantity of the springs 3.6 is increased, and the threshold is increased. When the material of the workpiece is easy to process, the quantity of the springs 3.6 is reduced, and the threshold is reduced.

Figure 6:
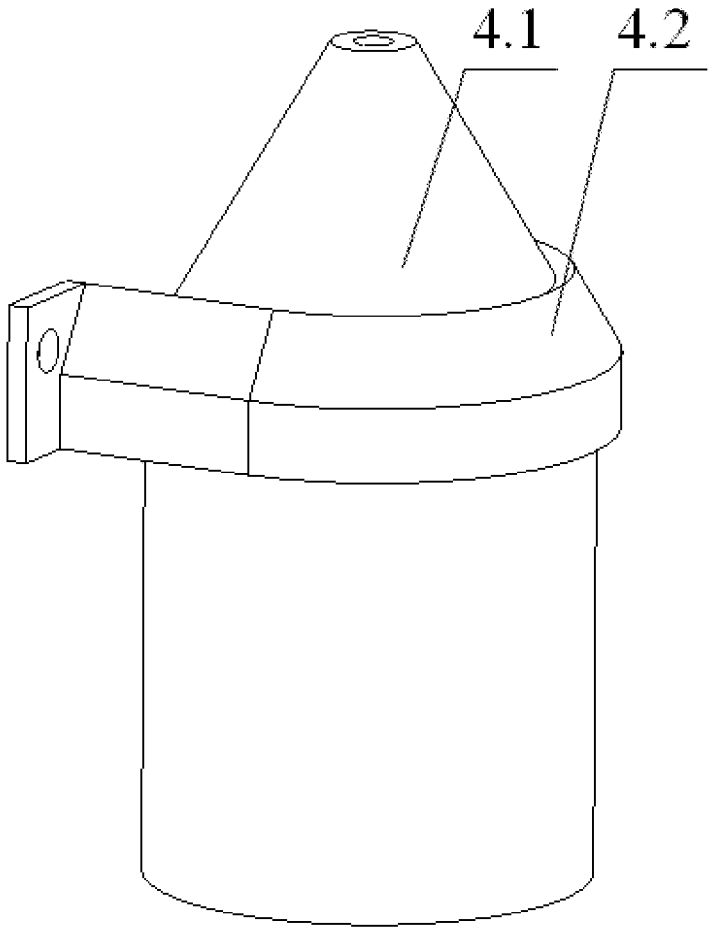
FIG. 6 is a three-dimensional schematic structural diagram of an instantaneous Cooling mechanism according to a specific implementation of the present invention.
Figure 7:
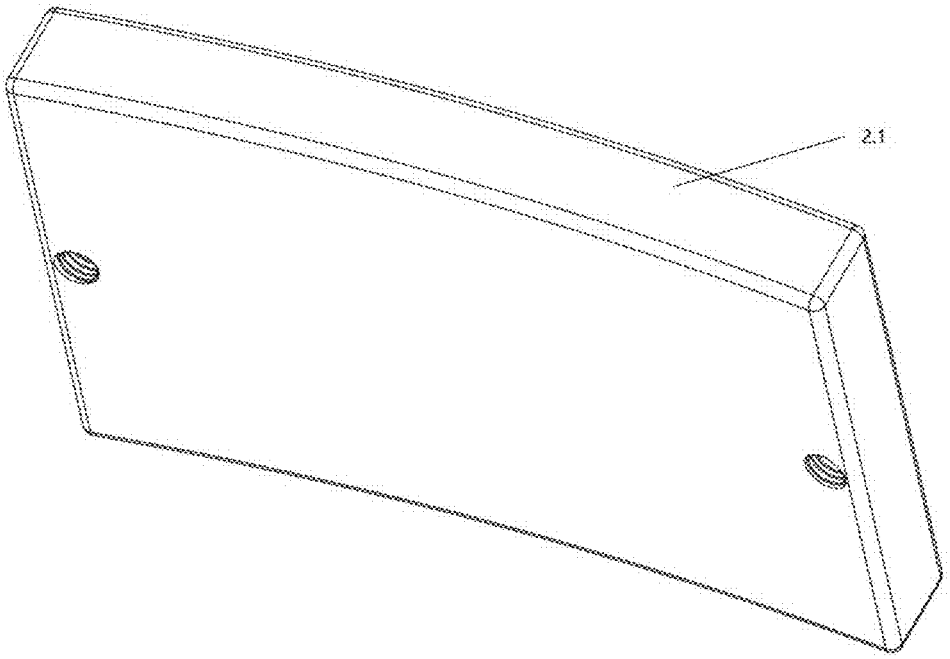
FIG. 7 is a schematic structual diagram of grinding unit.

Referring to FIG. 6, the instantaneous Cooling mechanism 4 includes a sprayer 4.1 and an annular fastener 4.2. The annular fastener 4.2 is connected to the grinding wheel substrate 1 by one or more bolts. The fastener clamps the sprayer 4.1, to implement fastening of sprayer for pressed spraying. The sprayer 4.1 includes nano fluid therein. The sprayer 4.1 is made of a silicone material. An upper half part of the sprayer is conical, and a lower half part of the sprayer is cylindrical. A small conical hole is opened at a top of the spray, so that a discharge amount of the nano fluid can be controlled. Nanoparticles contained in the nano fluid are molybdenum disulfide. When the nano fluid inside the sprayer 4.1 is insufficient, a syringe is used for replenishment.

Due to the structural characteristic, the grinding wheel is arranged to rotate only clockwise. When the grinding wheel operates, the grinding unit 2.1 in the execution mechanism 2 performs grinding processing on a workpiece, and generates a tangential grinding force. Because the springs have a large coefficient of elasticity, when the grinding wheel operates normally, the tangential grinding force is small, and the springs would not be compressed. When the tangential grinding force is suddenly increased due to complex working conditions and reaches a threshold, the grinding unit 2.1 slows down and rotates counterclockwise as compared to the whole diamond grinding wheel to drive the push rod 2.3 and the connecting rod 2.6, to push the main shaft 3.5. The piston 3.3 compresses the spring 3.6, to press the sprayer 4.1 to spray the nano fluid. Instantaneous Cooling of a grinding region of the grinding wheel is implemented based on conveyance of an external coolant, so that the tangential grinding force is reduced, and wear of the grinding wheel is reduced. When the tangential grinding force is reduced below the threshold or the grinding unit 2.1 no longer operates, the main shaft 3.5 moves to the right and is restored, and the sprayer 4.1 stops spraying the nano fluid.

Though the principle of the present invention has been described in detail above with respect to preferred embodiments of the present invention, those skilled in the art should understand that the above-mentioned embodiments are only explanations of schematic implementations of the present invention rather than limitation to the scope contained in the present invention. Specific details in embodiments do not limit the scope of the present invention. Without departing from the spirit and scope of the present invention, any obvious changes such as equivalent variations and simple replacements based on the technical solution of the present invention fall within the scope of protection of the present invention.

The invention claimed is:

1. A block-type structured diamond grinding wheel with adaptive supply of instantaneous cooling, wherein the grinding wheel is formed by a grinding wheel substrate (1) and several grinding wheel units, each grinding wheel unit includes an execution mechanism (2), a push mechanism (3), and an instantaneous cooling mechanism (4), the grinding wheel is arranged to rotate clockwise to process a workpiece by using the execution mechanism (2);

a plurality of grooves are opened in an outer circumferential surface of the grinding wheel substrate (1);

the grooves form an annular array structure on the outer circumferential surface of the grinding wheel substrate (1); each execution mechanism (2) includes a grinding unit (2.1), a hinge (2.2), a push rod (2.3) and a heat sink (2.4), wherein the grinding unit has an umbrella-shaped structure, an umbrella top of the grinding unit is arc-shaped, and a width of the grinding unit is the same as a width of the grinding wheel;

an upper surface of each grinding unit is coated with a layer of a diamond abrasive, and the diamond abrasive is ablated by using a laser process technique to form a structured pattern, one or more holes are opened at a bottom of the grinding unit, through which the grinding unit is mounted to the heat sink (2.4);

the bottom of the grinding unit (2.1) is hinged to the push rod (2.3) by the hinge (2.2), so as to drive the push mechanism (3) to press the instantaneous cooling mechanism (4) to spray nano fluid to implement instantaneous cooling of a grinding region where the grinding unit contacts the workpiece, when a tangential grinding force imposed on the grinding unit increases and exceeds a set threshold, wherein, the push mechanism (3) comprises an outer frame body (3.4), a main shaft (3.5), one or more springs (3.6), a piston (3.3), and a nut (3.2), a left end of the main shaft (3.5) passes through the outer frame body (3.4), the one or more springs (3.6) are disposed between the main shaft and the outer frame body (3.4), and the piston (3.3) is fastened to the main shaft (3.5) by the nut (3.2); and during operation, the piston (3.3) compresses the one or more springs (3.6) to drive the main shaft (3.5) to press a sprayer (4.1) of the instantaneous cooling mechanism (4).

2. The block-type structured diamond grinding wheel with adaptive supply of instantaneous cooling of claim 1, wherein the grinding unit (2.1) in the execution mechanism (2) is made of aluminum alloy; and the heat sink (2.4) is made of copper, and the heat sink has a sheet structure.

3. The block-type structured diamond grinding wheel with adaptive supply of instantaneous cooling of claim 2, wherein the grinding units (2.1) are separately chosen according to different processing conditions and processing requirements and are flexibly arranged on the grinding wheel, and after a grinding process ends, the grinding units (2.1) are detached and are kept for reassembly into the grinding wheel for another time of use in a next grinding process.

4. The block-type structured diamond grinding wheel with adaptive supply of instantaneous cooling of claim 1, wherein the instantaneous cooling mechanism (4) comprises an annular fastener (4.2), and the sprayer (4.1) is made of a silicone material.

5. The block-type structured diamond grinding wheel with adaptive supply of instantaneous cooling of claim 1, wherein nanoparticles contained in the nano fluid in the instantaneous cooling mechanism (4) are molybdenum disulfide.

* * * * *